United States Patent [19]

Akao et al.

[11] Patent Number: 4,875,442

[45] Date of Patent: Oct. 24, 1989

[54] CERAMIC ROCKER ARM

[75] Inventors: Shigeaki Akao; Masato Taniguchi, both of Aichi, Japan

[73] Assignee: NGK Spark Plug Co., Ltd., Nagoya, Japan

[21] Appl. No.: 288,128

[22] Filed: Dec. 22, 1988

[30] Foreign Application Priority Data

Dec. 24, 1987 [JP] Japan ..... 62-196253[U]

[51] Int. Cl.[4] ..... F01L 1/18

[52] U.S. Cl. ..... 123/90.39; 123/90.44

[58] Field of Search ..... 123/90.39, 90.41, 90.44, 123/90.51

[56] References Cited

U.S. PATENT DOCUMENTS

| | | | |
|---|---|---|---|
| 4,430,969 | 2/1984 | Holtzberg et al. | 123/90.39 |
| 4,438,738 | 3/1984 | Kosuda et al. | 123/90.39 |
| 4,667,627 | 5/1987 | Matsui et al. | 123/193 P |

FOREIGN PATENT DOCUMENTS

| | | | |
|---|---|---|---|
| 0091315 | 5/1983 | Japan | 123/90.39 |
| 62-206206 | 9/1987 | Japan . | |
| 0210207 | 9/1987 | Japan | 123/90.39 |
| 0210208 | 9/1987 | Japan | 123/90.39 |

*Primary Examiner*—Charles J. Myhre
*Assistant Examiner*—Weilun Lo
*Attorney, Agent, or Firm*—Foley & Lardner, Schwartz, Jeffery, Schwaab, Mack, Blumenthal & Evans

[57] ABSTRACT

A rocker arm comprises a main body section made of ceramics and a protective member section covering the outer surface of the main body section. The protective member section is in the form of a film or layer and made of a ductile material so that upon breakage of the ceramic main body section the protective member is plastically deformed to hold the broken pieces of the ceramic main body together.

6 Claims, 2 Drawing Sheets

CERAMIC ROCKER ARM

BACKGROUND OF THE INVENTION

I. Field of the Invention

The present invention relates in general to rocker arms for internal combustion engines and more particularly to an all ceramic rocker arm for an internal combustion engine.

II. Description of the Prior Art

An all ceramic rocker arm, i.e., a rocker arm entirely made of ceramics has been proposed for use in an automotive engine for the reason of a light weight, excellent wear resistivity and high rigidity, as disclosed in Japanese Provisional Patent Publication No. 62-206206.

The all ceramic rocker arm however has a possibility of being broken when subjected to such a large impact that is caused at the overspeed of the engine. When the rocker arm is broken, small broken pieces are scattered violently to damage the adjacent parts, and in some case the broken pieces are mixed with lubrication oil and intrude into the engine proper through the lubrication system to cause breakage or sudden stoppage of the engine proper, leading to a serious accident.

SUMMARY OF THE INVENTION

In accordance with the present invention, there is provided a rocker arm for an internal combustion engine which comprises a main body section made of ceramics and having an outer surface and a protective member section made of a ductile material and covering the outer surface of the main body section.

The above structure is effective for solving the above noted problem inherent in the prior all ceramic art rocker arm.

It is accordingly an object of the present invention to provide an improved rocker arm for an internal combustion engine which can assuredly prevent the adjacent parts of the engine and the engine proper from being damaged or broken even when the rocker arm is broken and therefore can assuredly prevent such breakage of the engine proper or sudden stoppage of same that leads to a serious accident.

DESCRIPTION OF THE PREFERRED EMBODIMENTS

Figure 1:
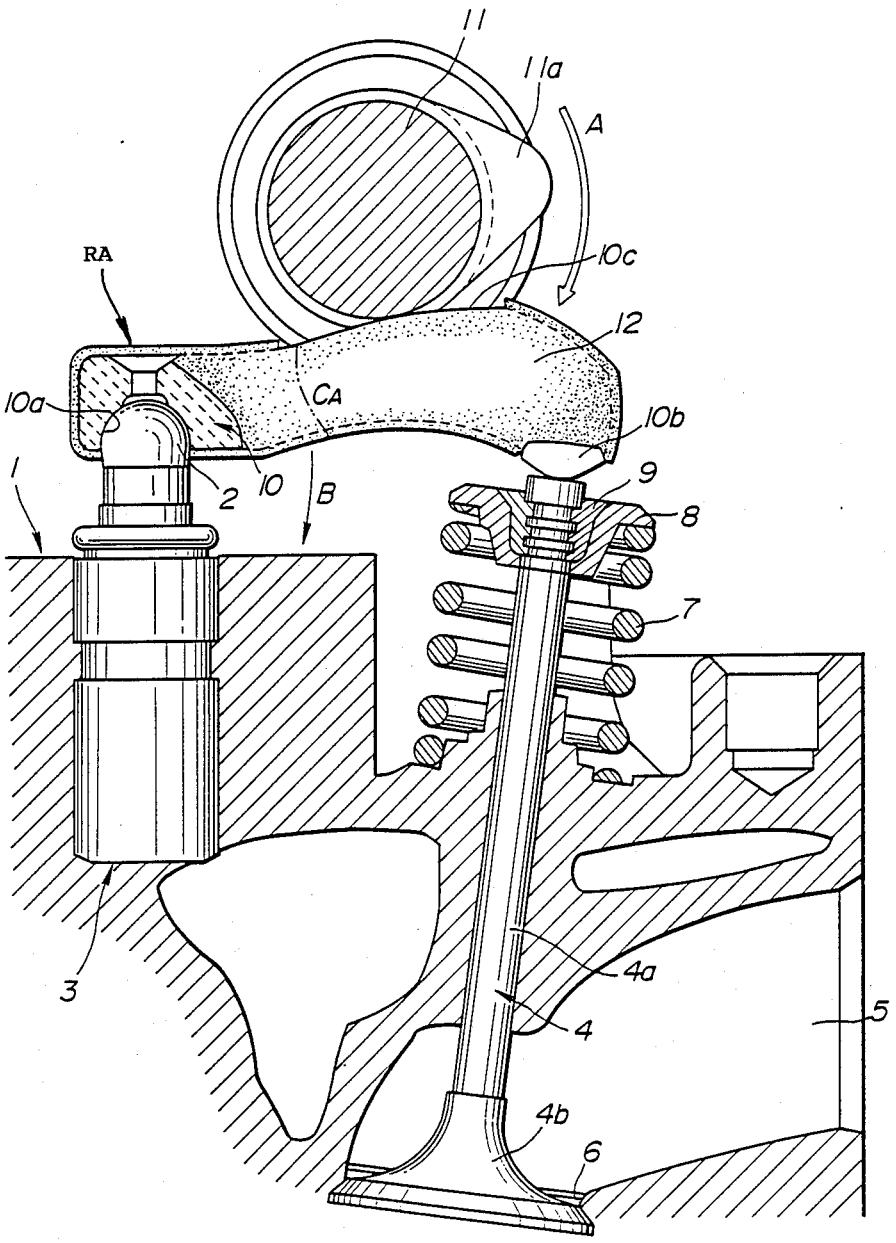
FIG. 1 is a fragmentary sectional view of an internal combustion engine incorporating a rocker arm according to an embodiment of the present invention.

Referring to FIG. 1, a cylinder head 1 installs thereon a lash adjuster 3 having a semi-spherical pivot 2. An exhaust valve 4 made of ceramics has a valve stem 4*a* and a valve head 4*b*. The valve stem 4*a* is axially movably installed in the cylinder head 1 so as to allow the head portion 4*b* to be seated on or unseated from a valve seat 6 installed in an exhaust port 5 and thereby open and close the exhaust port 5. A valve spring 7 is concentrically placed around the valve stem 4*a* and has a lower end brought into abutment upon the cylinder head 1 and an upper end attached to the valve stem 4*a* by way of a retainer 8 and a cotter 9. By this valve spring 7, the valve stem 4*a* is urged upward, and therefore the valve head 4*b* is urged against the valve seat 6 to close the exhaust port 5.

A rocker arm RA includes an all ceramic main body section, i.e., a main body section 10 made of ceramics such as silicon nitride for instance. The main body section 10 has at one longitudinal end a semi-spherical depression 10*a* in which the pivot 2 is slidably fitted or received and at the other longitudinal end a valve stem contacting portion 10*b* brought into contact with an upper end of the valve stem 4*a*. The main body section 10 is further formed with a cam contacting portion 10*c* on the side opposite to the side where the depression 10*a* and the valve stem contacting portion 10*b* are provided and in the place intermediate between the opposite longitudinal ends of the main body section 10, i.e., intermediate between the depression 10*a* and the valve stem contacting portion 10*b*.

A cam shaft 11 having a cam 11*a* is disposed in such a way as to hold the cam 11*a* in contact with the cam contacting portion 10*c*. When the cam shaft 11 rotates in the direction of the arrow "A", the cam 11*a* rotates in the corresponding direction while pushing the cam contacting portion 10*c* downward when the lobe of the cam 11*a* comes in contact with the surface portion 10*c*. By this, the rocker arm RA is caused to swing about the pivot 2 in the direction of the arrow "B" while pushing at the valve stem contacting portion 10*b* the valve stem 4*a* downward against the bias of the spring 7, thus allowing the valve head 4*b* to be unseated from the valve seat 6 and open the exhaust port 5. When the lobe of the cam 11*a* is disengaged from the cam contacting portion 10*c*, the rocker arm RA is caused to swing in the direction opposite to the arrow "B" under the bias of the spring 7, thus causing the valve stem 4*a* to move upward and thereby allowing close the exhaust port 5.

The rocker arm RA further includes a protective member section 12 which is in the form of film or layer which covers all the outer surface of the main body section 10 except for the semi-spherical depression 10*a*, valve stem contacting poriton 10*b* and the cam contacting portion 10*c*. The protecting member 12 is made of an organic substance and coated in place so as to be 0.5 mm thick for instance.

More specifically, the protective member section is made of chloroprene rubber, silicon rubber, fluoro rubber, adhesive angent mainly consisting of silicon rubber or adhesive agent mainly consisting of synthetic rubber, which is excellent in ductility, heat resistivity and oil resistivity and is adapted to have, for example, an elongation of 50% or more and a tensile strength of 20 $Kg/cm^2$ or more. In this instance, the protective member section 12 may be reinforced by mixing carbon fiber, glass fiber, plastic fiber such as niron fiber or whisker into the above described material.

With the above structure, when the ceramic main body section 10 is broken, the protective member section 12 holds the broken pieces together while being plastically deformed. By this, the broken pieces are prevented from being scattered over the adjacent parts, thus making it possible to prevent the adjacent parts from being damaged by the broken pieces whilst preventing the broken pieces from intruding into lubrication oil to cause breakage of the engine proper and sudden stoppage of same, leading to a serious accident.

A test was conducted with respect to the operation of the above described rocker arm RA of this invention under the condition that a predetermined number of rocker arms RA were incorporated in a 1.6-liter four-cylinder internal combustion engine together with a corresponding number of valves made of ceramics, and it was found that the engine started making a noise at the speed of 8300 rpm, being accompanied by reduction of the engine output. The engine was stopped immediately and disasssembled for check, and it was found that two of the eight rocker arms RA was broken at the portion indicated by the two-dot-chain line CA in FIG. 1. However, the broken pieces of the rocker arm RA were held together by the plastically deformed protective member section 12 and therefore prevented from being scattered over the adjacent parts. Accordingly, the adjacent part was not damaged and the breakage of the engine proper did not occur.

In contrast to this, a similar test was conducted with respect to prior art all ceramic rocker arms ad it was found that the engine started making a noise at the speed of 8300 rpm, being accompanied by reduction of the engine output, and stopped by itself a little later. The engine was disassembled for check and it was found that some of the rocker arms were broken and their broken pieces were scattered to damage the adjacent parts as the camshaft, engine cylinder, oil pump, etc., that is, breakage of the engine proper were caused.

In the above described embodiment incorporating the valve 4 made of ceramic, jumping and bouncing of the valve 4 is caused when the engine is operated at a certain over speed. When the engine speed further increases, jumping and bouncing becomes more violent to cause breakage of the valve 4 due to a large impact caused when the valve 4 strikes against the valve seat 6 or due to collision of the valve 4 with the piston head, thus allowing broken pieces of the valve 4 to intrude into the combustion chamber to damage the piston and cylinder and therefore causing breakage of the engine proper similarly to that in case of the rocker arm.

This problem can be solved by the rocker arm RA of this invention which is designed so as to be more fragile or so as to break more easily than the valve 4.

Figure 2:
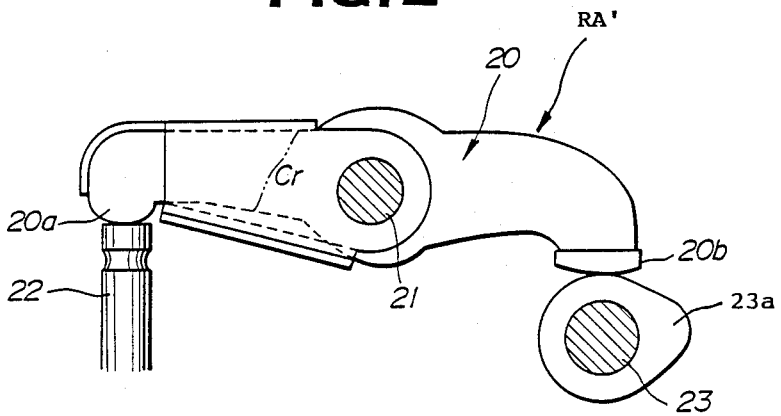
FIG. 2 is a side elevational view of a rocker arm according to another embodiment, together with a valve stem and cam.
Figure 3:
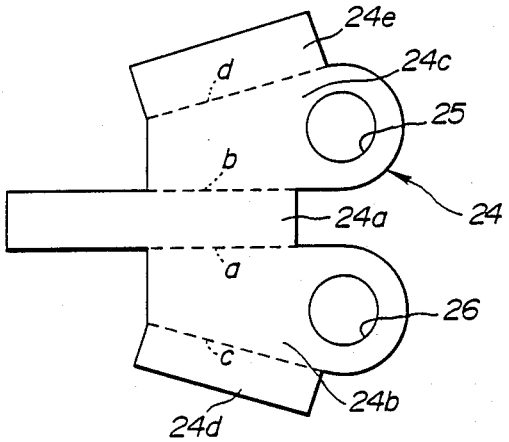
FIG. 3 is a development elevation of a protective member section employed in the rocker arm of FIG. 2.
Figure 4:
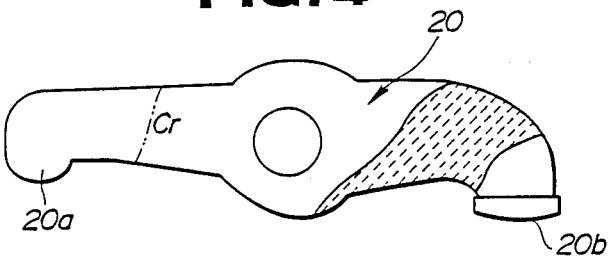
FIG. 4 is an all ceramic main body section employed in the rocker arm of FIG. 2.

Referring to FIGS. 2 to 4, a rocker arm RA' according to another embodiment consists of an all ceramic main body section 20 designed so as to break at a predetermined portion and a protective member section 24 covering the predetermined portion.

More specifically, the rocker arm RA' is of the type rotatably installed on a rocker shaft 21 at a portion intermediate between the opposite longitudinal ends and brought into contact with a valve stem of a valve 22 at one longitudinal end and with a cam of a camshaft 23 at the other end. That is, the main body section 20 is rotatably installed on the rocker shaft 21 at a portion intermediate between the opposite longitudinal ends and has at one longitudinal end a valve stem contacting portion 20*a* for contact with the valve stem of the valve 20 and at the other end a cam contacting portion 20*b* for contact with the cam of the camshaft 23.

The main body section 20 is designed so as to have a predetermined fragile portion Cr at which it is to be broken when its breakage occurs. The fragile portion Cr is indicated by the two-dot-chain line in FIG. 2 and located in the place where a maxiumum tensile stress occurs in the main body section 20 when the rocker arm RA' is in use. In this instance, the protective member section 24 is formed from a sheet of metal as mild steel, aluminium or the like of 0.8 mm thick, e.g., a metal having an elongation of 5% and a tensile strength of 20 $Kg/mm^2$. The protective member section 24, as shown in its developped form in FIG. 3, is in the form of having a top portion 24*a* laid on one side of the main body section 20 opposite to the side where the valve stem contacting portion 20*a* and the cam contacting portion 20*b* are provided and a pair of lateral portions 24*b* and 24*c* which are continuous with the top portion 24*a* and border on the bending lines "a" and "b". The lateral portions 24*b* and 24*c* are laid on the opposite sides of the main body section 20 spaced in the longitudinal direction of the camshaft 23 and formed with openings 25 and 26 through which the camshaft 23 extends. The protective member section 24further has a pair of bottom portions 24*d* and 24*e* which are continuous with the lateral portions 24*b* and 24*c* and border on the bending lines "c" and "d". The bottom portions 24*d* and 24*e* are laid on the side of the main body 20 opposite to the side on which the top portion 24*a* is laid. In installation, the top portion 24*a* of the protective member 24 is held in contact with the corresponding side of the main body section 20, and the protective member section 24 is bent at the bending lines "a" and "b" at right angles so that the openings 25 and 26 can receive therein the rocker shaft 21. The protective member 24 is then bent at the bending lines "c" and "d" at right angles so that the bottom portions 24*d* and 24*e* are laid on the corresponding side of the main body section 20. The protective member 24 is thus installed on the main body section in such a manner as to encircle or surround the main body section 20, particularly the fragile portion Cr of same.

A test was conducted with respect to operation of the rocker arm RA' of the embodiment of FIGS. 2 to 4 by installing the same on a 2.0-liter four-cylinder gasoline engine, and it was found that the engine started making a noise at the speed of 7700 rpm. The engine was thus stopped immediately and disassembled for check, and it was found that one of eight rocker arms RA' was broken at the portion Cr. However, though the protective member section 24 was deformed plastically, there were not any broken pieces scattered to damage the adjacent parts, and therefore the engine proper was effectively protected from damage.

In contrast to this, a similar test was conducted with respect to the prior art all ceramic rocker arm, and it was found that the engine started making a noise at the speed a little lower than 7700 rpm and breakage of the engine proper occured a little later together with damages of the adjacent parts.

By designing so that a rocker arm breaks at a predetermined portion and encircling the predetermined portion by a protective member, it becomes possible to reduce the material necessary for forming the protective member, thus being advantageous from the cost point of view.

What is claimed is:

1. A rocker arm for an internal combustion engine, comprising:

a main body section made of ceramics and having an outer surface; and a protective member section made of a ductile material and covering said outer surface of said main body section.

2. A rocker arm as set forth in claim 1 wherein said protective member section is in the form of a film of an organic substance.

3. A rocker arm as set forth in claim 1 wherein said protective member section is reinforced by fiber.

4. A rocker arm as set forth in claim 1 wherein said protective member section is formed from a sheet of metal.

5. A rocker arm as set forth in claim 1 wherein said main body section has a pivot contacting portion for contact with a pivot, valve conctacting portion for contact with a valve stem of a valve and cam contacting portion for contact with a cam, and said protective member section covers all of said outer surface of said main body section except for said pivot contacting portion, valve contacting portion and cam contacting portion.

6. A rocker arm as set forth in claim 1 wherein said main body section has a predetermined fragile portion, and said protective member section covers said fragile portion.

* * * * *